United States Patent [19]

Wang

[11] Patent Number: 4,754,380

[45] Date of Patent: Jun. 28, 1988

[54] CHARACTERS FOR ILLUMINATED DISPLAY SIGNS

[76] Inventor: Tien D. Wang, No. 26, Lane 293, Hua Cheng Rd., Hsin Chuang City, Taipei Hsien, Taiwan

[21] Appl. No.: 37,508

[22] Filed: Apr. 13, 1987

[51] Int. Cl.[4] ..... F21V 5/00

[52] U.S. Cl. ..... 362/244; 362/812

[58] Field of Search ..... 362/244, 245, 238, 237, 362/239, 812; 40/452, 508, 576, 596

[56] References Cited

U.S. PATENT DOCUMENTS 4,532,579 7/1985 Merryman ..... 362/812 X

*Primary Examiner*—Lloyd L. King

*Attorney, Agent, or Firm*—Keaty & Keaty

[57] ABSTRACT

A character for illuminated display signs comprising elements in the form of quadrangular prism and isosceles triangular prism provided with a bulb therein and engaged by interconnectors so that the bulbs are electrically connected in parallel.

7 Claims, 5 Drawing Sheets

CHARACTERS FOR ILLUMINATED DISPLAY SIGNS

BACKGROUND OF THE INVENTION

The present invention relates to an illuminated character for an illuminated display sign.

Conventional illuminated characters for illuminated display signs are usually formed by arranging a plurality of bulbs in the form of the desired characters. Once the character is formed, the sockets for its bulb are fixed in an unchangeable way, and cannot be easily disassembled and then reassembled into another character.

Accordingly, it is the main object of the present invention to provide a combination character for illuminated display signs, whereby the aforesaid disadvantage is obviated.

SUMMARY OF THE INVENTION

In accordance with the present invention, a character can be formed by two kinds of illuminated elements and one kind of an interconnector. The two elements are either in the form of a quadrangular prism or an isosceles triangular prism. The two prisms have the same height. The two lateral sides of the isosceles triangle are equal to the side of the square. On each of the four lateral sides of the quadrangular prism and on each of the three lateral sides of the triangular prism, there are provided at least two socket holes into which the interconnectors can be inserted. With the interconnector, a plurality of prisms can be mechanically and electrically engaged to form the desired illuminated character.

The character elements are mechanically connectable to form a character (for example, letter) outline which comprises a straight angle and a non-right angle. A bulb is provided in each element. When the elements are engaged, their bulbs are electrically in parallel with each other.

This invention will be better understood when read in connection with the acompanying drawings, wherein:

DETAILED DESCRIPTION OF THE PREFERRED EMBODIMENT

Figure 1:
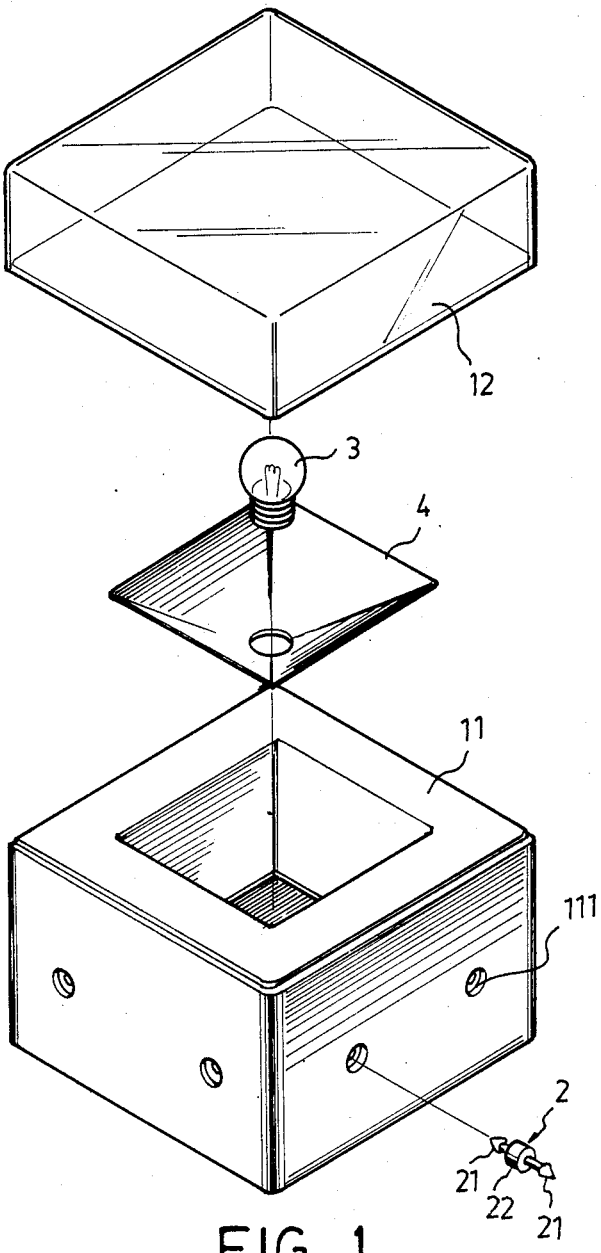
FIG. 1 is a perspective view of an illuminated element in the form of a quadrangular prism according to the present invention.

With reference to FIG. 1, there is shown an illuminated character element 1 in the form of a quandrangular prism. In order that a bulb 3 can be easily inserted or replaced, the illuminated character element is formed by a base 11 and a transparent cover 12. The cover can be pleated or hued. A reflector 4 is provided around the bulb 3 to focus the light. Each of the four lateral sides of the base 11 is respectively provided with two sockets 111.

Figure 2:
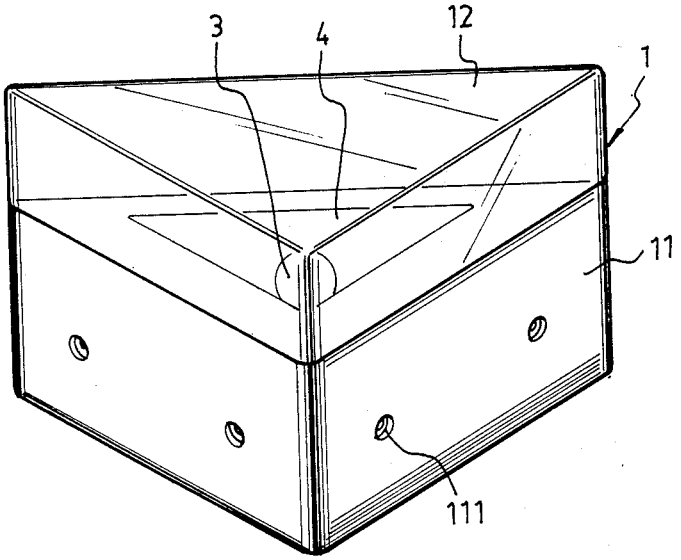
FIG. 2 is a perspective view of an illuminated element in the form of a triangular prism in accordance with the present invention.

FIG. 2 shows another illuminated character element 1 in the form of a right-angle isosceles triangular prism. Here, the longest side of the right-angle isosceles triangle is also provided with socket holes (not shown).

Figure 3:
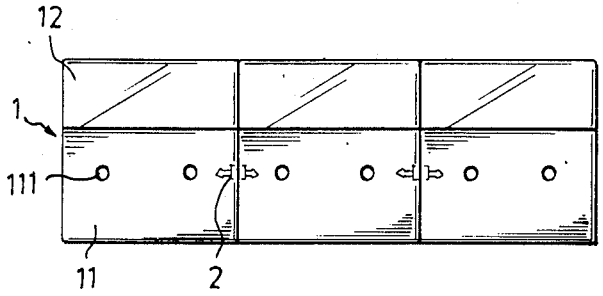
FIG. 3 is an elevational view showing three interconnected elements.
Figure 4:
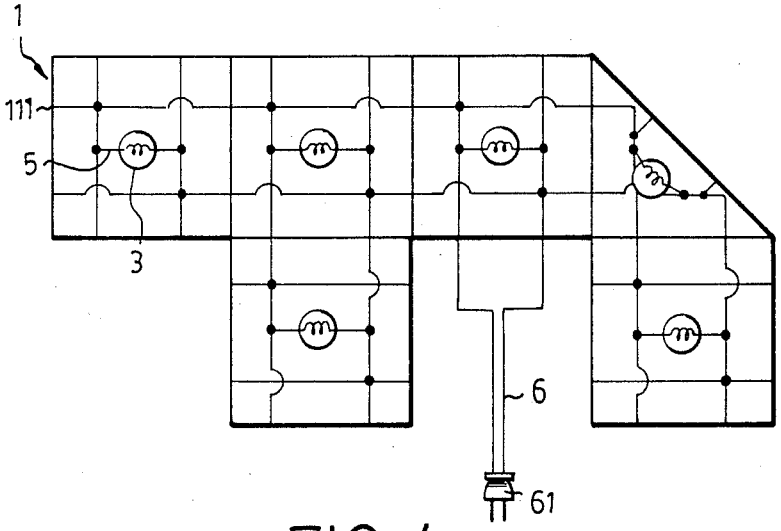
FIG. 4 is a wiring diagram of a character in accordance with the present invention.

FIG. 1 also shows an interconnector 2 which has two opposite pins 21 extending from a connector body 22. The diameter of the connector body 22 is approximately equal to the diameter of a socket hole 111, whereas the axial length of the connector body 22 is about twice the depth of the socket hole. Therefore, when two elements 1 are engaged by two interconnectors, their adjacent sides are close in contact with each other. FIG. 3 illustrates the connection of three character elements.

The wiring of each element 1 is such that the bulbs 3 of the interconnected elements 1 are in parallel. FIG. 3 illustrates a simplest embodiment in which each side of an element is provided with two terminals. Since all the interconnected elements are electrically in parallel, only one plug 61 with two cords 6 is required to energize the whole character.

Figure 5:
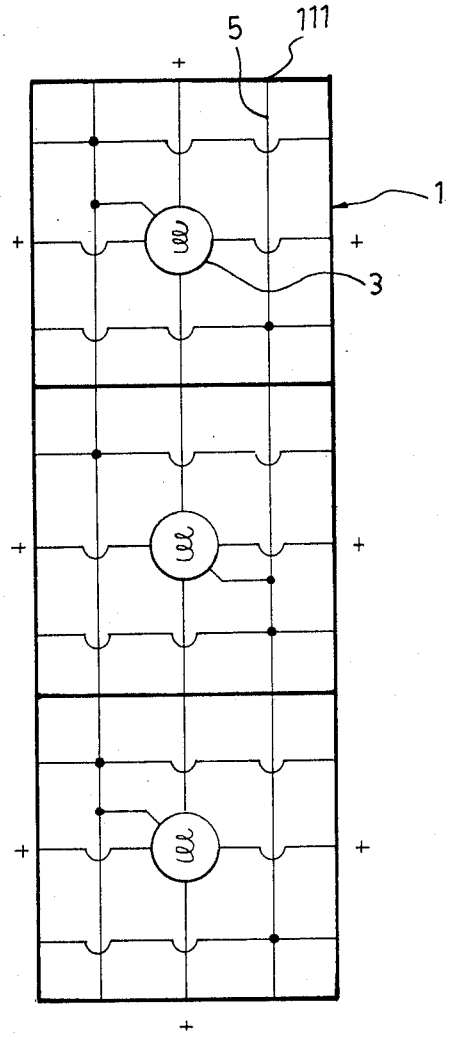
FIG. 5 is another wiring embodiment, in which each side of an element has three contacts.

FIG. 5 illustrates another wiring embodiment, in which each side of the element 1 has three terminals instead of two.

When an element of a character is electrically connected to an element of another character, which is adjacent to it, then all elements of the characters are electrically in parallel, and require only one plug to connect with an energy source.

Figure 7:
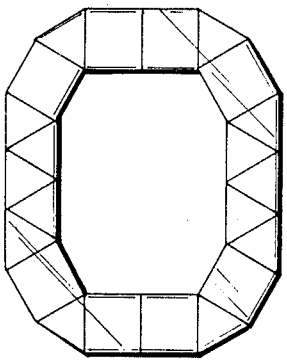
FIG. 7 is another character according to the present invention using equilateral triangular elements.

The isosceles triangle is not necessarily right-angled. It can also be equilateral triangle. FIG. 7 illustrates an example using elements in the form of an equilateral triangular prism.

Figure 6:
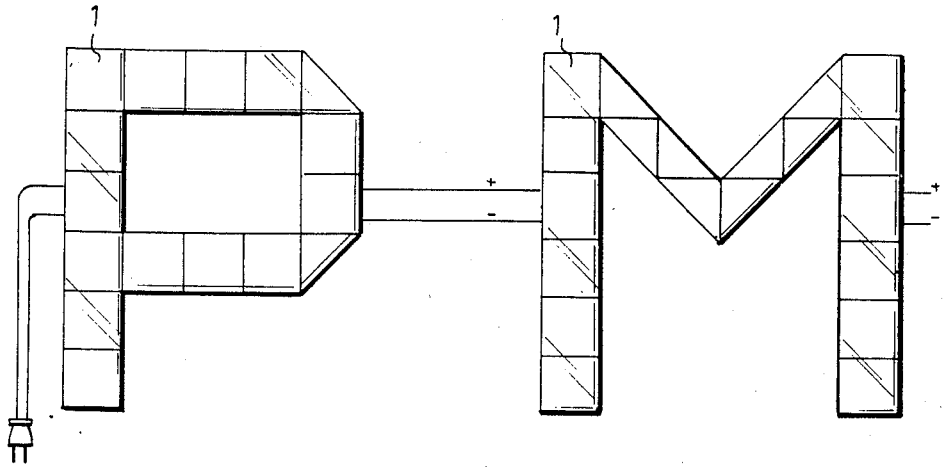
FIG. 6 is a display sign formed by the characters according to the present invention.

As can be seen in FIG. 6 of the drawing, the letters "P" and "M" are formed by the character elements in accordance with the present invention. The first letter element shown in FIG. 6, letter "P", is formed by elements arranged together and mechanically connected so that the outline of the character elements is formed by straight angles, rights angles and a number of non-right angles. Specifically, the angles forming the right hand upper and lower outline portions of letter "P" are formed by obtuse and acute angles, while the outline of the letter "M" is formed by straight angles and a plurality of acute angles.

As shown in FIG. 7, the letter "O" is formed by an outline comprising a number of straight angles and obtuse angles, so that the overall effect would closely approach a curved outline of the letter. As can be seen in the drawings, the adjoining sides of the character elements have the same length so that smooth non-interrupted outlines are formed when the character elements are connected to form a character.

It is to be understood that various changes and modifications of the details presented herein may readily occur to persons skilled in the art without departure from the spirit and scope of the invention. Therefore, the exact details shown and described hereinabove are not to be construed as limiting the invention.

I claim:

1. A character for illuminated display signs, comprising:

a character element in the form of a prism being adapted for receiving a lighting means therein, each lateral side of the prism being provided with at least two apertures to receive an interconnector means for mechanically and electrically interconnecting the character element to an adjacent character element in such a manner that the lighting means of the character elements are electrically connected in parallel, and the character elements being mechanically connectable to form a character outline comprising at least one straight angle and at least one non-right angle.

2. A character for illuminated display signs, comprising:

at least one character element in the form of a quadrangular prism;

at least one character element in the form of an isosceles triangular prism;

the character elements being adapted for receiving lighting elements therein, each lateral side of the character elements being provided with at least two apertures to receive interconnector means therein for mechanically and electrically interconnecting the character elements in such a manner that the lighting means of the character elements are electrically connected in parallel, the character elements being mechanically connectable to form a character outline comprising at least one straight angle and at least one non-right angle.

3. A character for illuminated display signs, comprising: a character element in the form of an isosceles prism adapted for receiving a lighting means therein, each lateral side of the character element being provided with at least two apertures to receive interconnector means for mechanically and electrically interconnecting the character element to an adjacent character element in such a manner that the lighting means of the character elements are electrically connected in parallel, and the character elements being mechanically connectable to form a character outline comprising at least one straight angle and at least one non-right angle.

4. The character of claim 1, wherein the prism is a quadrangular prism.

5. The character of claim 1, wherein the interconnector element comprises a generally cylindrical body with a pair of connector pins extending from opposite sides of the cylindrical body for engagement with an aperture in the lateral side of the character element.

6. The character element of claim 1, further provided with a reflector means for focusing light from the lighting means mounted within the character element to a top of the character element.

7. The character of claim 1, wherein the character element comprises a base means housing the lighting means and a transparent top means engageable with the base means, and wherein the apertures for interconnecting adjacent character elements are made in the base means.

* * * * *